US007147580B2

(12) United States Patent
Nutter et al.

(10) Patent No.: US 7,147,580 B2
(45) Date of Patent: Dec. 12, 2006

(54) WARM-UP BAT

(75) Inventors: Mark E. Nutter, Newark, OH (US); Robert A. Maron, Hebron, OH (US); Jacob Nutter, Newark, OH (US)

(73) Assignee: Nutter Sports, L.L.C., Hebron, OH (US)

( * ) Notice: Subject to any disclaimer, the term of this patent is extended or adjusted under 35 U.S.C. 154(b) by 0 days.

(21) Appl. No.: 11/033,507

(22) Filed: Jan. 12, 2005

(65) Prior Publication Data

US 2005/0153797 A1 Jul. 14, 2005

Related U.S. Application Data

(60) Provisional application No. 60/535,546, filed on Jan. 12, 2004.

(51) Int. Cl.
*A63B 69/00* (2006.01)

(52) U.S. Cl. ..... 473/457; 473/564

(58) Field of Classification Search ..... 473/457, 473/437, 422, 519, 520, 564–568
See application file for complete search history.

(56) References Cited

U.S. PATENT DOCUMENTS

| | | | | |
|---|---|---|---|---|
| 514,420 | A * | 2/1894 | Jacobus | 473/564 |
| 1,499,128 | A * | 6/1924 | Shroyer, Jr. | 473/519 |
| 2,379,006 | A * | 6/1945 | Johnson | 473/568 |
| 2,780,698 | A | 2/1957 | Youhouse | |
| 2,986,937 | A | 6/1961 | Chapman | |
| 3,116,926 | A * | 1/1964 | Owen et al. | 473/457 |
| 3,137,504 | A * | 6/1964 | Zordan et al. | 473/457 |
| 3,578,801 | A | 5/1971 | Piazza | |
| 3,955,816 | A | 5/1976 | Bratt | |
| 3,963,239 | A * | 6/1976 | Fujii | 473/519 |
| 4,006,900 | A | 2/1977 | DiVito | |
| 4,274,631 | A | 6/1981 | Hayazaki | |
| 4,325,549 | A * | 4/1982 | Vasselli | 473/519 |
| 4,363,488 | A | 12/1982 | Maroth et al. | |
| 4,399,996 | A | 8/1983 | Boyce | |
| 4,555,111 | A | 11/1985 | Alvarez | |
| 4,600,190 | A | 7/1986 | Berkoff | |
| 4,634,121 | A | 1/1987 | Sasaki | |
| 4,671,508 | A | 6/1987 | Tetreault | |
| 4,763,899 | A | 8/1988 | Hundley | |
| 4,768,785 | A | 9/1988 | Patterson | |
| 4,819,935 | A | 4/1989 | Dirksing et al. | |
| 4,898,384 | A | 2/1990 | Beach | |
| 4,898,386 | A | 2/1990 | Anderson | |
| 4,969,921 | A | 11/1990 | Silvera | |
| 5,024,436 | A | 6/1991 | Vento | |
| 5,050,877 | A | 9/1991 | Wales | |
| D339,621 | S | 9/1993 | Briden | |
| 5,277,421 | A * | 1/1994 | Rewolinski | 473/457 |

(Continued)

FOREIGN PATENT DOCUMENTS

| | | |
|---|---|---|
| GB | 2 382 782 A | 6/2003 |

*Primary Examiner*—Mitra Aryanpour
(74) *Attorney, Agent, or Firm*—Richard C. Litman

(57) ABSTRACT

A warm-up bat includes a tubular shell with a handle section, a barrel section, and a tapered section connecting the handle section with the barrel section. The handle is attached at an end of the handle section of the bat. An end cap is attached at an end of the barrel section of the bat. A sliding weight mechanism is entirely contained within the barrel section of the bat, and is positionally supported on a shaft.

4 Claims, 6 Drawing Sheets

U.S. PATENT DOCUMENTS 5,360,209 A 11/1994 Mollica
5,380,002 A * 1/1995 Spector ..... 473/519
5,393,055 A 2/1995 McKay, Jr.
5,577,966 A 11/1996 Duran
5,590,875 A 1/1997 Young
6,050,908 A * 4/2000 Muhlhausen ..... 473/457
6,254,502 B1 * 7/2001 Becker ..... 473/594
2003/0013563 A1 1/2003 Ryan
2003/0144089 A1 7/2003 Ryan

* cited by examiner

WARM-UP BAT

CROSS-REFERENCE TO RELATED APPLICATION

This application claims the benefit of U.S. Provisional Patent Application Ser. No. 60/535,546, filed Jan. 12, 2004, which is incorporated herein by reference.

BACKGROUND OF THE INVENTION

1. Field of the Invention

The present invention generally relates to exercising and training for baseball and softball and, more particularly, to a warm-up bat that incorporates a sliding weight mechanism inside the barrel of a metallic or composite hard shell bat.

2. Description of Related Art

When a baseball or softball player attempts to hit a baseball or softball during a game, the player initially takes a standing position at the plate and holds a bat in a rearward cocked position. Once the pitch is thrown, the player swings the bat from the laterally rearward cocked position, through a frontal hitting position, and to a follow-through laterally forward position. The player swings the bat at an appropriate time after the pitcher facing the player has thrown the ball towards the plate where the player is standing. The player begins swinging the bat at the appropriate time. The swing is based on the player making the necessary eye and arm coordination for swinging the bat at the appropriate time in view of the perceived travel of the baseball towards the plate. The batter must take into account the speed of the ball, the type of pitch and the expected flight path to the plate. Ideally, the bat impacts the baseball and causes the ball to travel outwardly from the plate into the game field, or preferably beyond.

Many techniques and devices for improving the batting abilities of baseball and softball players are known to exist, both with a fixed weight and those with a sliding weight. However, none of these techniques and devices includes a bat which provides the weight, balance, and performance of a standard game bat, and does not include external attachments, and does not have an irregular shape. Therefore, a need exists for a warm-up bat that provides the tactile feel, weight, balance, and performance of a standard game bat, does not have any external attachments, and does not have an irregular shape.

The related art is represented by the following references of interest.

U.S. Patent Application Publication No. 2003/0013563 A1, published Jan. 16, 2003 for Richard L. Ryan, describes a baseball practice bat with a fixed handle, a movable handle, and a projection extending from the fixed handle and/or the movable handle. When the movable handle is rotationally aligned with the fixed handle and is moved toward the fixed handle, the projection connects with a first portion of the other of the fixed handle and the movable handle, thereby creating a first sound. When the movable handle is rotationally unaligned with the fixed handle and is moved toward the fixed handle, the projection connects with a second portion of the other of the fixed handle and the movable handle, thereby creating a second sound. The Ryan '563 application does not suggest a warm-up bat according to the claimed invention.

U.S. Patent Application Publication No. 2003/0144089 A1, published Jul. 31, 2003 for Richard Ryan, describes a baseball practice bat a shaft, a knob, a barrel, and a movable handle. The movable handle is located around the shaft between the barrel and the knob, and is configured to translate along the shaft to provide indication of a correct baseball bat swing. The motion of the movable handle toward the knob is sensed during the execution of a swing. The Ryan '089 application does not suggest a warm-up bat according to the claimed invention.

U.S. Pat. No. 2,780,698, issued Feb. 5, 1957 for Joseph Youhouse, describes a thermostatic switch with a bent contact-carrying arm which is actuated by a heat responsive means so that it is stiffened. The Youhouse patent does not suggest a warm-up bat according to the claimed invention.

U.S. Pat. No. 2,986,937, issued on Jun. 6, 1961 for Loyal H. Chapman, describes a lineal yardage meter attachment for golf clubs. The Chapman patent does not suggest a warm-up bat according to the claimed invention.

U.S. Pat. No. 3,578,801, issued on May 18, 1971 to Raymond Piazza, describes a hollow baseball bat for baseball practice that has an internal longitudinal rod and a movable weight which increases the inertia of the bat during a swing. The Piazza patent does not suggest a warm-up bat according to the claimed invention.

U.S. Pat. No. 3,955,816, issued on May 11, 1976 to Loanard R. Bratt, describes a warm-up bat with a closeable hollow chamber provided with granular weight material therein that results in a practice bat with a distributed weight or bat-like feel. The Bratt patent does not suggest a warm-up bat according to the claimed invention.

U.S. Pat. No. 4,006,900, issued on Feb. 8, 1977 to Joseph A. DiVito, describes a baseball apparatus including a bat, ball, and glove. The bat, ball, and glove are magnetically arranged such that the ball is attracted to the glove and bat in such a manner that players may hold the bat extended with the ball affixed to it, disconnect it quickly with a slight jerk, strike the ball, and cause it to go directly to the baseball glove. The DiVito patent does not suggest a warm-up bat according to the claimed invention.

U.S. Pat. No. 4,274,631, issued on Jun. 23, 1981 to Tadao Hayazaki, describes a baseball practice bat which emits hitting sounds upon swinging. The Hayazaki patent does not suggest a warm-up bat according to the claimed invention.

U.S. Pat. No. 4,363,488, issued on Dec. 14, 1982 to Arthur M. Maroth et al., describes a spring-force indicator for a playing piece of sports equipment. The Maroth et al. patent does not suggest a warm-up bat according to the claimed invention.

U.S. Pat. No. 4,399,996, issued on Aug. 23, 1996 to Gary C. Boyce, describes a baseball practice bat for training baseball players the art of batting. The Boyce patent does not suggest a warm-up bat according to the claimed invention.

U.S. Pat. No. 4,555,111, issued on Nov. 26, 1985 to Manuel R. Alverez, describes a practice bat for baseball players that includes a handle portion and a weighted end portion interconnected by a resilient spring. The Alverez patent does not suggest a warm-up bat according to the claimed invention.

U.S. Pat. No. 4,600,190, issued on Jul. 15, 1986 to Andrew J. Berokoff, describes an exercise device having a bat which applies a restraining to the swinging thereof. The Berokoff patent does not suggest a warm-up bat according to the claimed invention.

U.S. Pat. No. 4,634,121, issued on Jan. 6, 1987 to Yuuki Sasaki, describes a bat swing practice device. The Sasaki patent does not suggest a warm-up bat according to the claimed invention.

U.S. Pat. No. 4,671,508, issued on Jun. 9, 1987 to Albert G. Tetreault, describes a golf club swing trainer. The Tetreault patent does not suggest a warm-up bat according to the claimed invention.

U.S. Pat. No. 4,763,899, issued on Aug. 16, 1988 to W. Maynard Hundley, describes a flexible weighted device for the purpose of practice or warm-up. The Hundley patent does not suggest a warm-up bat according to the claimed invention.

U.S. Pat. No. 4,768,785, issued on Sep. 6, 1988 to George Patterson, describes a practice device for assisting a batter in learning a proper swing. The Patterson patent does not suggest a warm-up bat according to the claimed invention.

U.S. Pat. No. 4,809,975, issued on Mar. 7, 1989 to Boyong Lee, describes a golf club swing trainer. The Lee patent does not suggest a warm-up bat according to the claimed invention.

U.S. Pat. No. 4,819,935, issued on Apr. 11, 1989 to John L. Dirksing et al., describes a training bat for ball games. The Dirksing et al. patent does not suggest a warm-up bat according to the claimed invention.

U.S. Pat. No. 4,898,384, issued on Feb. 6, 1990 to G. Michael Beach, describes a batting aid system for training a baseball player to properly swing a baseball bat. The Beach patent does not suggest a warm-up bat according to the claimed invention.

U.S. Pat. No. 4,898,386, issued on Feb. 6, 1990 to Donald A. Anderson, describes a training bat including a hollow cylindrical bat with a handle and a striking end. The Anderson patent does not suggest a warm-up bat according to the claimed invention.

U.S. Pat. No. 4,969,921, issued on Nov. 13, 1994 to Richard Silvera, describes a golf club swing training device. The Silvera patent does not suggest a warm-up bat according to the claimed invention.

U.S. Pat. No. 5,024,436, issued on Jun. 18, 1991 to Sammy J. Vento, describes a baseball bat exercising device. The Vento patent does not suggest a warm-up bat according to the claimed invention.

U.S. Pat. No. 5,050,877, issued on Sep. 24, 1991 to Alan Wales, describes a batting aid system for training a baseball player to properly swing a baseball bat. The Beach patent does not suggest a warm-up bat according to the claimed invention.

U.S. Pat. No. 5,360,209, issued on Nov. 1, 1994 to Robert D. Mollica, describes a batting training device. The Mollica patent does not suggest a warm-up bat according to the claimed invention.

U.S. Pat. No. 5,393,055, issued on Feb. 28, 1995 to Jack McKay, Jr., describes a batting aid system for training a baseball player to properly swing a baseball bat. The Beach patent does not suggest a warm-up bat according to the claimed invention.

U.S. Pat. No. 5,577,966, issued on Nov. 26, 1996 to Anthony R. Duran, describes a sport swing training device for practicing the swing of a ball-hitting device. The Duran patent does not suggest a warm-up bat according to the claimed invention.

U.S. Pat. No. 5,590,875, issued on Jan. 7, 1997 to Gary Young, describes a baseball bat and a baseball which are provided with an audible signal generating element. The Young patent does not suggest a warm-up bat according to the claimed invention.

Great Britain Patent Application Publication No. GB 2 382 782 A, published on Jun. 11, 2003, describes a configuration for baseball bat where the center of gravity is altered automatically during the swing to provide greater impact on a ball. The Great Britain application does not suggest a warm-up bat according to the claimed invention.

None of the above inventions and patents, taken either singly or in combination, is seen to describe the instant invention as claimed. Thus a warm-up bat solving the aforementioned problems is desired.

SUMMARY OF THE INVENTION

The present invention is a warm-up bat including a tubular shell with a handle section, a barrel section, and a tapered section connecting the handle section with the barrel section. A handle is attached at an end of the handle section of the bat. An end cap is attached at an end of the barrel section of the bat. A sliding weight mechanism is entirely contained within the barrel section of the bat, and is positionally supportable within the barrel section of the bat. The bat includes a shaft and the sliding weight mechanism has one or more components mounted on the shaft.

The handle section has a generally circular interior with a wall thickness that defines inner and outer diameters along its length. The barrel section has a generally circular interior with a wall thickness that defines inner and outer diameters along its length. The tapered section has a variable interior with a wall thickness along its length that defines variable inner and outer diameters along its length.

One example of the sliding weight mechanism includes one or more components including a bolt, a magnet, a sliding weight with bushings, and a foam ball. The foam ball is configured to absorb impact of the sliding weight. The sliding weight is configured for being held by the magnet until a predetermined amount of force is applied to the sliding weight through a swing of the bat.

Another example of sliding weight mechanism includes a tapered end plug, a bolt, a spring, a magnet, and a sliding weight with bushings. The tapered end plug includes a centrally positioned aperture configured for enabling the bolt to be passed therethrough. The spring is configured to inhibit the noise that may occur when the sliding weight moves from a position proximate the end cap and return to a position near the magnet.

The tapered end plug is configured to be inserted through the barrel section and to provide a positional end point for the sliding weight mechanism by frictionally engaging with the tapered section of the bat proximate to where the inner diameter of the tapered section corresponds to the inner diameter of the barrel section of the bat. Once the tapered end plug has been inserted in the barrel section of the bat, the shaft may be secured to the end cap by the bolt. When the sliding weight mechanism is inserted into the barrel section of the bat, the bat appears the same as a typical bat used in a baseball or softball game. The warm-up bat is used by a player by being swing in the same fashion as during a game, but is intended for training and exercising purposes, and not to contact a ball.

As the swinging motion causes the warm-up bat to increase speed, the magnetic force on the sliding weight is overcome, allowing the sliding weight to slide on the shaft. The player feels the corresponding shift in mass as the swing progresses. When the sliding weight reaches the end of the shaft, at the end of the barrel section proximate the end cap, the sliding weight is dampened mechanically by the cylindrical portion of the end cap. Therefore, little or no sound is heard, but the player feels the impact of the sliding weight at the end of the bat.

A warm-up bat may be equipped with a sliding weight mechanism alternatively configured to include a tapered end plug, a die spring, fingers, a plate, a cushion, and a sliding weight with bushings. The sliding weight has a necked down feature, enabling it to be held by the spring loaded fingers. These fingers are held in place on a plate, and allowed to pivot on pins. A die spring or similar spring forces the ends of the fingers open, thus keeping the sliding weight restrained by the closed end of the fingers. A cushion material prevents metal to metal contact between the sliding weight and the plate. With this sliding weight mechanism, the swing of the bat similarly causes the sliding weight to push away from the handle portion of the bat and toward the end cap of the bat, but the sliding weight is not released until sufficient force is generated to overcome the spring pressure on the fingers.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
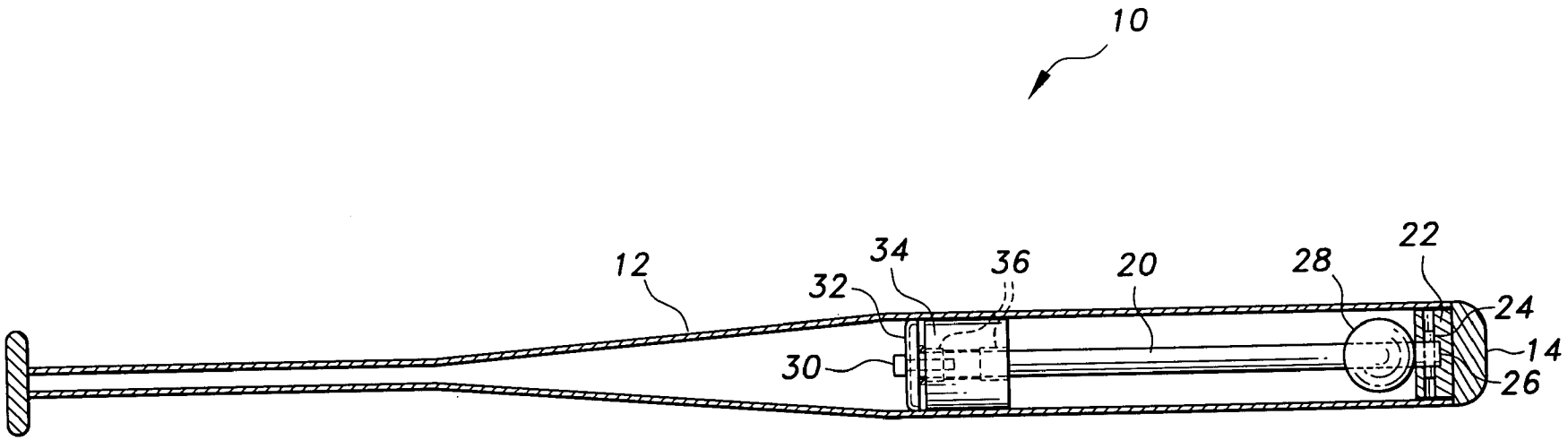
FIG. 1 is a cross-sectional side view of a warm-up bat according to the present invention.

The present invention is a warm-up bat. The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

Figure 2:
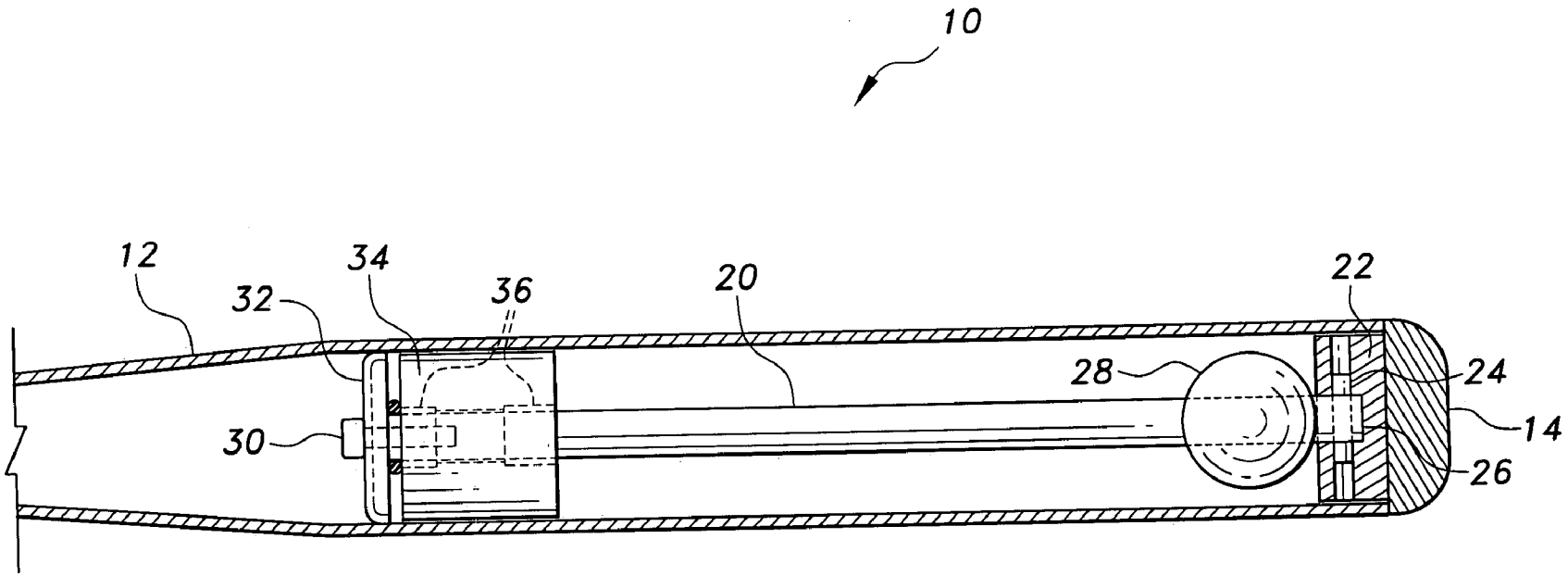
FIG. 2 is enlarged cross-sectional view of the warm-up bat shown in FIG. 1.

Referring to the drawings, FIGS. 1 and 2 show one example of a warm-up bat 10 according to the invention. The warm-up bat 10 includes a tubular shell 12, a handle, and an end cap 14. The tubular shell 12 is made of metal, metal alloy, or a metal composite, such as aluminum, titanium, steel, titanium aluminum alloys, titanium alloys, nickel alloys, metal matrix composite alloys, combinations thereof, or the like. The tubular shell 12 includes a handle section, a barrel section, and a tapered section connecting the handle section with the barrel section. The handle section has a generally circular interior with a wall thickness that defines inner and outer diameters along its length. The barrel section has a generally circular interior with a wall thickness that defines inner and outer diameters along its length. The tapered section has a variable interior with a wall thickness along its length that defines variable inner and outer diameters along its length.

The wall thickness of the handle, barrel, and tapered sections may be substantially the same. However, the wall thickness of the barrel section may be thicker than the wall thickness of the handle section to provide weight characteristics of the warm-up bat 10 similar to those of conventional game bats. The inner diameter of the handle section is smaller than the inner diameter of the barrel section, and the inner diameter of the tapered section varies from an inner diameter substantially the same as the inner diameter of the handle section to an inner diameter substantially the same as the inner diameter of the barrel section.

The handle is configured for being attached to the end of the handle section of the bat, and is made of durable material. The end cap 14 is configured to be attached to the end of the barrel section of the bat. The end cap 14 has a circular outer portion and a cylindrical inner portion 22. The cylindrical inner portion is dimensioned to be received within the end of the barrel section of the bat 10, and the shaft 20 may be interconnected with the cylindrical inner portion 22 of the end cap 14 by a roll pin 24 through the end 26 of the shaft 20. Alternatively, the end cap 14 may include an integral bolt with a threaded end configured to enable the end cap 14 to be screwed to the end of the barrel section of the bat 10 (see FIGS. 4–6).

While the end cap 14 may be made of material similar to the tubular shell 12, the end cap 14 may be injection molded of material, such as polyurethane or the like. The handle is configured to be attached to the end of the handle section of the bat. The handle section of the bat 10 may be covered by a suitable gripping material layer, which may be an adhesive strip wound around the handle section.

The warm-up bat 10 includes a sliding weight mechanism that is entirely contained within the barrel section of the bat, and is positionally supported on the shaft 20. The sliding weight mechanism shown in FIGS. 1 and 2 includes a bolt 30, a magnet 32, and a sliding weight 34 with bushings 36. A foam ball 28 is positioned on the shaft 20 proximate the end cap 14. The foam ball is configured to absorb the impact of the sliding weight 34 when it reaches that portion of the shaft 20.

When the sliding weight mechanism is inserted into the barrel section of the bat 10, the bat 10 appears the same as a typical bat used in a baseball or softball game. The warm-up bat 10 is used by a player by being swing in the same fashion as during a game, but is intended for training and exercising purposes, and not to contact a ball.

As the swinging motion causes the warm-up bat 10 to increase speed, the magnetic force on the sliding weight 34 is overcome, allowing the sliding weight 34 to slide on the shaft 20. The player feels the corresponding shift in mass as the swing progresses. When the sliding weight 34 reaches the end of the shaft 20, at the end of the barrel section proximate the end cap 14, the sliding weight 34 is dampened mechanically by the foam ball 28. Therefore, little or no sound is heard, but the player feels the impact of the sliding weight 34 at the end of the bat 10.

Figure 3:
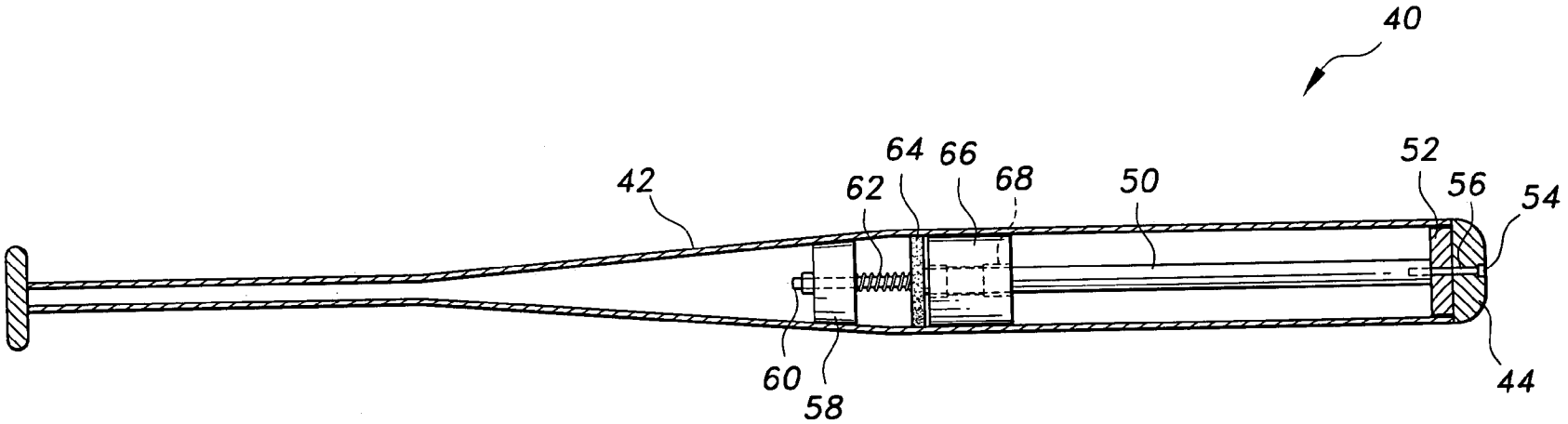
FIG. 3 is a cross-sectional side view of a warm-up bat according to the present invention.
Figure 4:
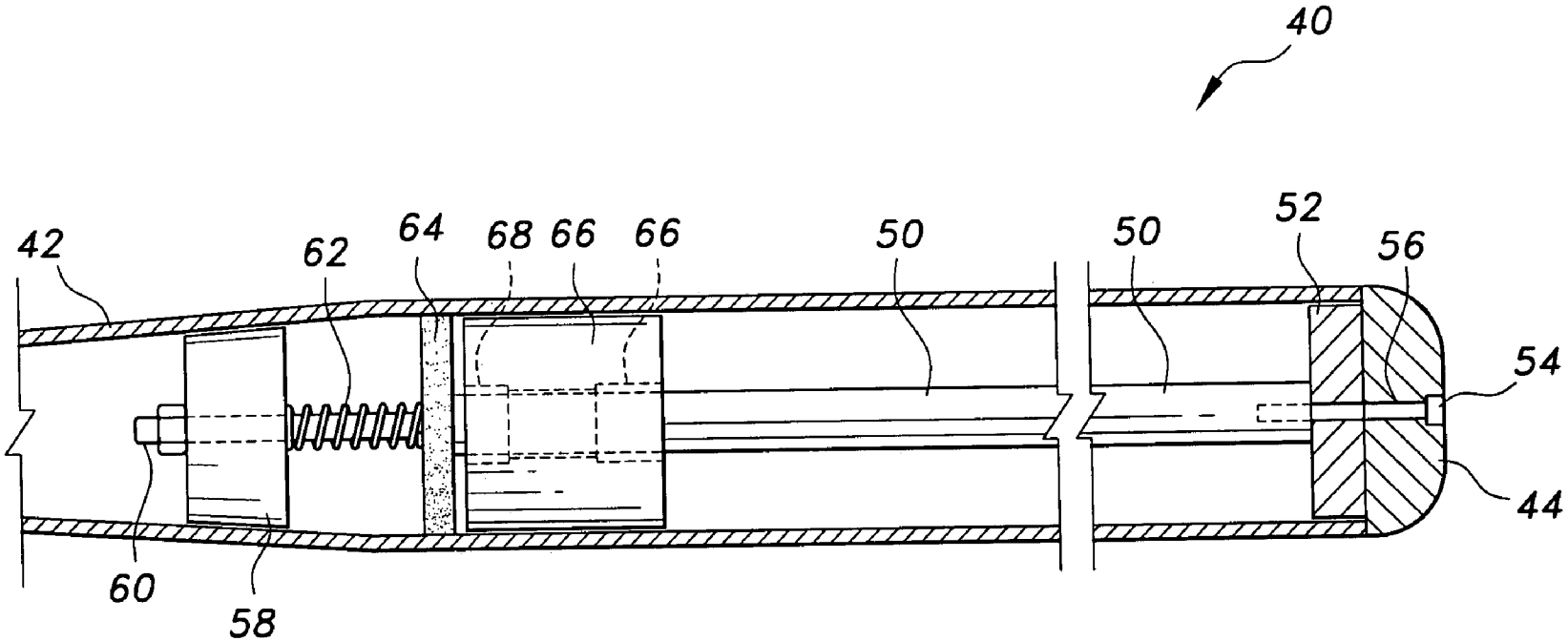
FIG. 4 is enlarged cross-sectional view of the warm-up bat shown in FIG. 3.

As shown in FIGS. 3 and 4, a bat 40 may be equipped with a sliding weight mechanism alternatively configured to include a tapered end plug 58, a bolt 60, a spring 62, a magnet 64, and a sliding weight 66 with bushings 68. The tapered end plug 58 includes a centrally positioned aperture configured for enabling the bolt 60 to be passed therethrough. The spring 62 is configured to inhibit the noise that may occur when the sliding weight 66 moves from a position proximate the end cap 54 and return to a position near the magnet 64.

The tapered end plug 58 is configured to be inserted through the barrel section and to provide a positional end point for the sliding weight mechanism by frictionally engaging with the tapered section of the bat proximate to where the inner diameter of the tapered section corresponds to the inner diameter of the barrel section of the bat 40. Once the tapered end plug 58 has been inserted in the barrel section of the bat, the shaft 50 may be secured to the end cap 44 by the bolt 54. When the sliding weight mechanism is inserted into the barrel section of the bat 40, the bat 40 appears the same as a typical bat used in a baseball or softball game. The warm-up bat 40 is used by a player by being swing in the same fashion as during a game, but is intended for training and exercising purposes, and not to contact a ball.

As the swinging motion causes the warm-up bat 40 to increase speed, the magnetic force on the sliding weight 66 is overcome, allowing the sliding weight 66 to slide on the shaft 50. The player feels the corresponding shift in mass as the swing progresses. When the sliding weight 66 reaches the end of the shaft 50, at the end of the barrel section proximate the end cap 54, the sliding weight 54 is dampened mechanically by the cylindrical portion 52 of the end cap 54. Therefore, little or no sound is heard, but the player feels the impact of the sliding weight 66 at the end of the bat.

Figure 5:
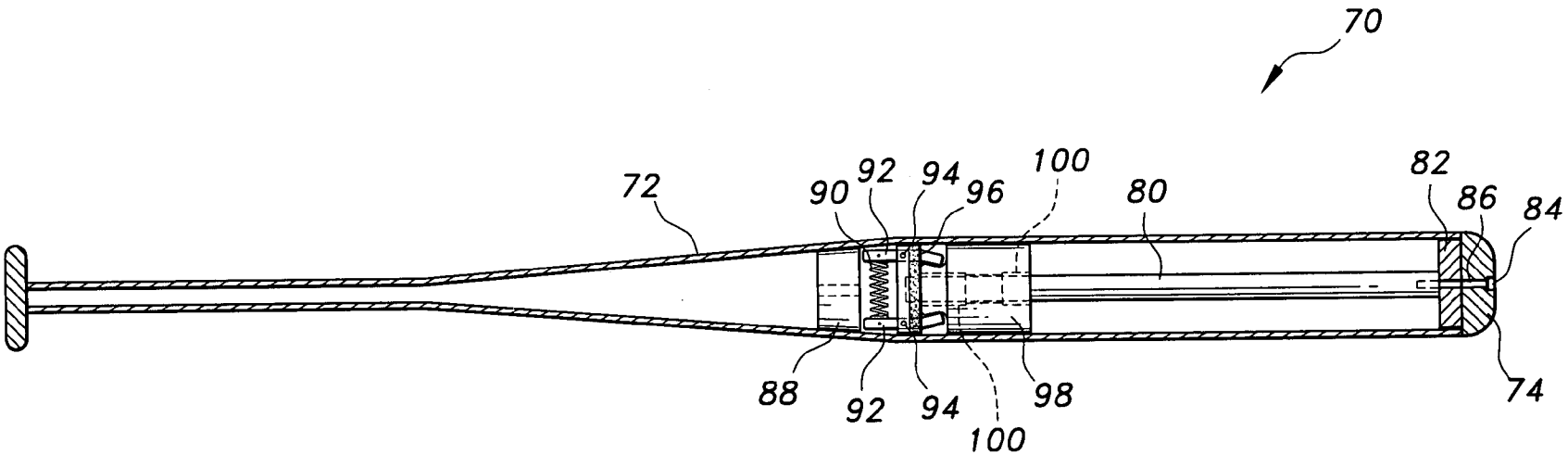
FIG. 5 is a cross-sectional side view of a warm-up bat according to the present invention.
Figure 6:
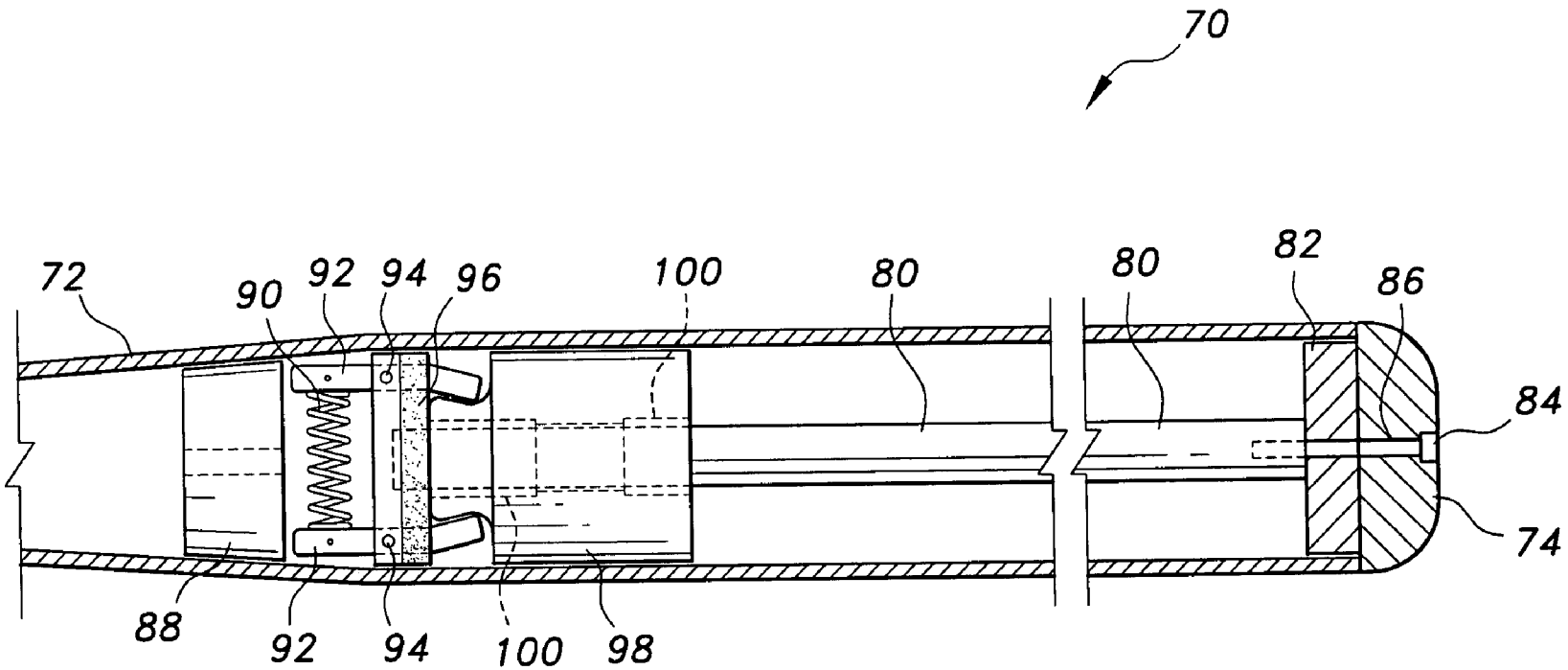
FIG. 6 is an enlarged cross-sectional view of the warm-up bat shown in FIG. 5.

As shown in FIGS. 5 and 6, a bat 70 may alternatively be equipped with sliding weight mechanism alternatively configured to include a tapered end plug 88, a die spring 90, fingers 92, a plate, a cushion 96, and a sliding weight 98 with bushings 100. The sliding weight 98 has a necked down feature, enabling it to be held by the spring loaded fingers 92. These fingers 92 are held in place on a plate, and allowed to pivot on pins 94. A die spring or similar spring 90 forces the ends of the fingers 92 open, thus keeping the sliding weight 98 restrained by the closed end of the fingers 92. A cushion material 94 prevents metal to metal contact between the sliding weight 98 and the plate. With this sliding weight mechanism, the swing of the bat 70 similarly causes the sliding weight 98 to push away from the handle portion of the bat 70 and toward the end cap 74 of the bat 70, but the sliding weight 88 is not released until sufficient force is generated to overcome the spring pressure on the fingers 92.

The warm-up bat of the present invention does not have a spring or cord attached to the sliding weight. The sliding weight is free slide along the shaft once the restraining force is overcome. The warm-up bat, when fully assembled, appears similar to like a standard game bat, with no external attachments or irregular shapes. The warm-up bat is intended to limit the sound produced by the weight when impacting either end, rather than generate a click or other sound. The tactile feel of the weight transfer is an important feature of the warm-up bat.

While the invention has been described with references to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

We claim:

1. A warm-up bat comprising:

a tubular shell with a handle section, a barrel section, and a tapered section connecting the handle section with the barrel section;

a handle attached at an end of the handle section of the bat;

an end cap attached to an end of the barrel section of the bat opposite said tapered section;

a sliding weight mechanism;

said sliding weight mechanism being entirely contained within the barrel section of the bat, and positioned within the barrel section of the bat;

said sliding weight mechanism comprising:

an elongated shaft having a first end and a second end, said shaft first end affixed to said end cap, said shaft extending within the barrel section of said bat and terminating at said second end, said second end being located proximate to said tapered section of said bat;

a magnet affixed to the second end of said shaft by a bolt extending through said magnet and axially engaging said shaft second end;

a foam ball positioned on said shaft, said foam ball being located adjacent to said end capt; and a magnetically attractable weight slidably supported on said shaft by at least one bushing disposed between said weight and said shaft, said weight being slidable along said shaft from said magnet to said foam ball;

wherein said weight is configured for being held by the magnet until a predetermined amount of force is applied to the weight through a swing of the bat, whereby the force of the magnet is overcome allowing the weight to slide on the shaft.

2. The warm-up bat of claim 1, wherein said at least one bushing is a pair of bushings.

3. The warm-up bat of claim 1, wherein said end cap includes a circular outer portion and a cylindrical inner portion, said cylindrical inner portion disposed within the barrel section of said bat; and said shaft first end is affixed to said end cap cylindrical inner portion by a roll pin through said cylindrical inner portion of said end cap and said shaft first end.

4. The warm-up bat of claim 1, wherein said shaft first end is affixed to said end cap by a bolt extending through said end cap and axially engaging said first end of said shaft.

* * * * *